US010207721B2

(12) United States Patent
Hubmann et al.

(10) Patent No.: US 10,207,721 B2
(45) Date of Patent: Feb. 19, 2019

(54) BOGIE FRAME

(71) Applicant: Siemens AG Oesterreich, Vienna (AT)

(72) Inventors: Markus Hubmann, Brodingberg (AT); Radovan Seifried, Maribor (SI)

(73) Assignee: Siemens AG Österreich, Vienna (AT)

( * ) Notice: Subject to any disclaimer, the term of this patent is extended or adjusted under 35 U.S.C. 154(b) by 190 days.

(21) Appl. No.: 15/126,972

(22) PCT Filed: Feb. 25, 2015

(86) PCT No.: PCT/EP2015/053950

§ 371 (c)(1),
(2) Date: Sep. 16, 2016

(87) PCT Pub. No.: WO2015/139926

PCT Pub. Date: Sep. 24, 2015

(65) Prior Publication Data

US 2017/0096150 A1 Apr. 6, 2017

(30) Foreign Application Priority Data

Mar. 19, 2014 (AT) ..... A 50194/2014

(51) Int. Cl.
*B61F 5/52* (2006.01)

(52) U.S. Cl.
CPC ..... *B61F 5/52* (2013.01)

(58) Field of Classification Search
CPC ..... B61F 5/52
See application file for complete search history.

(56) References Cited

U.S. PATENT DOCUMENTS

| | | | | |
|---|---|---|---|---|
| 700,992 | A * | 5/1902 | Symons | B61F 5/52 105/208 |
| 3,338,183 | A * | 8/1967 | Boissier | B61F 5/30 105/167 |
| 4,161,913 | A * | 7/1979 | Guillaumin | B61F 5/52 105/200 |
| 8,720,346 | B2 * | 5/2014 | Shinmura | B61C 17/00 105/172 |
| 2014/0137765 | A1 * | 5/2014 | Nishimura | B61F 5/52 105/182.1 |
| 2015/0083019 | A1 * | 3/2015 | Nishimura | B61F 5/32 105/197.05 |

(Continued)

FOREIGN PATENT DOCUMENTS

| | | |
|---|---|---|
| BE | 671217 A | 2/1966 |
| CN | 1112887 | 12/1995 |

(Continued)

*Primary Examiner* — Jason C Smith
(74) *Attorney, Agent, or Firm* — Cozen O'Connor

(57) ABSTRACT

A bogie frame for a rail vehicle that includes two longitudinal supports formed as open and closed hollow profiles, and at least one transverse support, wherein the hollow profile of the longitudinal support is formed by wall elements having a defined thickness, wherein in order to reduce the weight of bogie frames in comparison to conventional bogies frames and to save on production costs, the longitudinal supports, in the region at which the at least one transverse support engages, is respectively provided in a wall element with at least one area having a reduced thickness.

24 Claims, 2 Drawing Sheets

(56) References Cited

U.S. PATENT DOCUMENTS

| | | | | |
|---|---|---|---|---|
| 2015/0344047 | A1* | 12/2015 | Nishimura | B61F 5/52 105/197.05 |
| 2017/0096150 | A1* | 4/2017 | Hubmann | B61F 5/52 |
| 2017/0232979 | A1* | 8/2017 | Zhang | B61F 5/52 105/198.1 |
| 2017/0282939 | A1* | 10/2017 | Hubmann | B61F 3/04 |
| 2017/0291618 | A1* | 10/2017 | Karner | B61F 5/52 |
| 2018/0029616 | A1* | 2/2018 | Hubmann | B61F 1/08 |
| 2018/0043910 | A1* | 2/2018 | Hubmann | B61F 5/52 |

FOREIGN PATENT DOCUMENTS

| | | | |
|---|---|---|---|
| EP | 0 260 440 | A1 | 3/1988 |
| EP | 0441313 | | 8/1991 |
| EP | 1 125 817 | A2 | 8/2001 |
| EP | 1 232 085 | A | 8/2002 |
| JP | 53-11416 | | 2/1978 |
| JP | 57-91838 | | 6/1982 |
| JP | 2013/166508 | A | 8/2013 |
| RU | 2011140165 | | 4/2013 |
| WO | WO 01/36246 | A1 | 5/2001 |
| WO | WO 01/85522 | A1 | 11/2001 |

* cited by examiner

BOGIE FRAME

CROSS-REFERENCE TO RELATED APPLICATIONS

This is a U.S. national stage of application No. PCT/EP2015/053950 filed 25 Feb. 2015. Priority is claimed on Austrian Application No. A50194/2014 filed 2014 Mar. 19, the content of which is incorporated herein by reference in its entirety.

BACKGROUND OF THE INVENTION

1. Field of the Invention

The invention relates to a bogie frame for a rail vehicle, which incorporates two longitudinal members in the form of open or closed hollow profiles, and at least one transverse member, where the hollow profile of the longitudinal member is formed by wall elements having a particular thickness.

The invention can be applied both to bogie frames with the bogie bearings mounted internally, whereby in the assembled state the wheels of the rail vehicle are arranged outside the longitudinal members, and can also be applied to bogies with external bearings.

2. Description of the Related Art

In a bogie, the transmission of force between the various functional units, such as the drive or brake, is handled by the bogie frame. Especially in the case of bogies for high-speed trains, high longitudinal and diagonal rigidity of the bogie frame is an operational requirement for the wheel sets. Due to the high loadings arising in operation, and the required operational security, the bogie frame is manufactured at high material and production costs. Apart from the high costs in technical respects, this results in the bogie frame having a high weight.

In order to accommodate the high loadings on the bogie frame, to manufacture the bogie frame use is made of open or closed hollow profiles that are produced from plates that are welded together. In operation, the welded seams are subject to basically high loadings.

In the case of closed hollow profiles, the production of an opposing welded seam on the side of the welded seam root is no longer possible, due to the lack of accessibility, so that the welded seam cannot be subjected to the same forces as when made with an opposing weld. Here, the plate thicknesses must be increased to be able then to make the welded seam thicker and thus also stronger. Alternatively, the longitudinal member can be made with a cover, which makes it possible to weld the welded seams in the inside. Disadvantages of this method are a significantly increased production expenditure due to the longer welding time, an increased manipulation expenditure, and the covering parts that are additionally required. In summary, the weight of the bogie frame and the production costs are further increased.

SUMMARY OF THE INVENTION

In view of the foregoing, it is thus an object of the present invention to provide a bogie frame for a rail vehicle, which incorporates two longitudinal members constructed as open or closed hollow profiles and at least one transverse member, where the hollow profile of the longitudinal member is formed by wall elements that have a particular thickness, which by comparison with the above-described conventional bogie frame has less weight, or a lower production expenditure, as applicable, and which thus implies lower production costs.

This and other objects and advantages are achieved in accordance with the invention by a bogie frame in which each longitudinal member of the bogie frame has, in the region of attachment of at least one transverse member, a wall element with at least one region having a reduced thickness. This reduced thickness can be realized in that the wall element is milled out in the aforementioned place. Here, a wall element can have only one continuous region with reduced thickness. Or a wall element could also have several separate regions with reduced thickness.

In general, the wall elements have a constant thickness, so that in the region with the reduced thickness the wall element has a thickness that is reduced in comparison to the remainder of the wall element. Here, it is conceivable that, in the region with the reduced thickness, this thickness is constant apart from a border region, where the border region, as a transition from the thickness of the remainder of the wall element to the thickness of the region with a reduced thickness, has a chamfer.

In a particular embodiment, the thickness of the wall element in the region with the reduced thickness (except for the border region of the region with the reduced thickness) amounts at most to 90% of the thickness of the wall element outside the region with the reduced thickness, preferably lying in the range from 10-90%, in particular in the range from 30-70%.

The expression "region of the attachment of the at least one transverse member" means the section of the longitudinal member onto which the transverse member attaches, together with the part enclosed by it. It can also, however, be understood as that part of the longitudinal member lying immediately around this section, that is, for example, the part of the longitudinal member that lies closer to the transverse member than the ends of the longitudinal member, the middle of the longitudinal member or another transverse member.

The deformation in the region of the welded seam is reduced by the region with reduced thickness, and the stresses in the welded seam are thus reduced. This makes it possible to reduce the weight, and also means that no covers are necessary, so that the production effort is reduced.

In another particular embodiment, on a side that faces the at least one transverse member, each of the longitudinal members has on its inside a wall element in the form of a ridge with an inner side, on which inner side is provided at least one region having a reduced thickness. That is, at the place where the transverse member is joined on, the thickness of the inner ridge on the side facing away from the transverse member is reduced, which especially reduces the deformation in the region of those welded seams that are nearest to the region with the reduced thickness.

It is a further embodiment, each of the longitudinal members has a wall element in the form of an outside ridge with an inner side that lies opposite to the inner ridge that faces the at least one transverse member, and on which inner side is arranged at least one region with reduced thickness. This changes the deformation characteristic of the longitudinal member, which leads to a reduction in the deformation in the region of those welded seams located nearest to the region with the reduced thickness. In general, there will be a region both on the inner and also on the outer ridge on the longitudinal member (in particular congruent ones) with a reduced thickness.

The ridges on the longitudinal members can be formed in such a way that around the region with reduced thickness there remains, at least partially, a border that extends from 10-30% of the height of the ridge. Thus the ridges can have such a border, extending on their upper sides up to the upper web of the longitudinal member and/or on their lower sides down to the lower web of the longitudinal member. The stresses on the welded seams, between the ridge and upper web and/or between the ridge and lower web, would then be reduced.

If each of the longitudinal members incorporates at least one connection element, which serves as the connection for the at least one transverse member and which has at least one wall element with a region of reduced thickness, then it is possible to control particularly well the deformation at the transition from the longitudinal member to the transverse member, and also the stresses on the welded seams between the internally-located ridge in the longitudinal member and the connection element (box profile), between the connection element and the connecting plate and/or the wall elements of the hollow profile of the longitudinal member. Here, the term "connection element" refers to the element that is located between the transverse member and the remainder of the longitudinal member, and which forms the connection for the transverse member.

In one embodiment of the bogie frame, the connection element is constructed as a box profile with two wall elements constructed as connection ridges, together with one wall element, constructed as an upper web, which connects the two connection ridges, and one wall element constructed as a lower web which also connects the two connection ridges, where the connection ridges together with the upper web and the lower web stand orthogonally to a side of the longitudinal member which faces the at least one transverse member. Additionally, in the operating position the upper web is arranged at the top and the lower web at the bottom. Here, the term "box profile" refers to a closed hollow profile which incorporates four wall elements, where however none of the wall elements need to be aligned parallel to another wall element and the wall elements can even have curvatures. The term orthogonal is to be understood as meaning that the connection ridges, together with the upper web and also the lower web form planes on the surfaces that are parallel to the longitudinal axis of the transverse member. The term connection ridges is to be understood as meaning the side parts, and the term upper web as the upper part and lower web as the lower part, of the box profile.

In another embodiment of the bogie frame, the connection ridge has at least one region with a reduced thickness, by which it is possible to reduce the stresses in the welded seams that are located nearest to the region with the reduced thickness.

In a further embodiment of the bogie frame, the connection ridge incorporates a border of uniform thickness around the at least one region with a reduced thickness. The region with a reduced thickness thus lies centrally in the wall element concerned, which produces a uniform distribution of the forces in the wall element. If the border is narrow in comparison to the dimensions of the region with a reduced thickness, this makes an increased contribution to the weight saving. For example, the border can extend over 10% to 30%, in particular over 20%, of the surface of the inner side of the connection ridge.

In particular, the at least one region with a reduced thickness is provided on an outer side of the connection ridge. The outer side is easily accessible. As a result, this represents a particularly simple but nevertheless effective possibility.

In general (both for the longitudinal member itself and also for its connection element) the region with a reduced thickness will as a rule be produced, in particular milled out, on the individual part, i.e., on the individual wall element (and only then are the individual parts welded together). Here, the region with a reduced thickness is produced on the same side as the welded seam chamfer, so that any rejigging of the wall element between the production of the region with a reduced thickness and the welded seam chamfer can be eliminated. In the case of wall elements that are essentially rectangular, the shape of the region with a reduced thickness (viewed in the plane of the wall element (will also mostly be essentially rectangular.

In an embodiment of the bogie frame, the connection element the region with a reduced thickness corresponds to 20-90%, in particular 40-80% of the surface of the outer side.

In a further embodiment of the bogie frame, the upper web of the connection element has at least one region with a reduced thickness. This offers a reduction in the stress on the welded seam in the upper region that lies nearest to the region with a reduced thickness.

In a still further embodiment, the at least one region with a reduced thickness is provided on an outer side of the upper web of the connection element. The outer side is easily accessible. As a result, this represents a particularly simple but nevertheless effective possibility. Here, again, it is the case that the region with a reduced thickness is, as a rule, produced on the individual part on the same side as the welded seam chamfer, so that any rejigging of the wall element between the production of the region with a reduced thickness and the welded seam chamfer can be eliminated.

The rigidity is yet further increased if the upper web of the connection element forms a closure in one plane with an upper web of the longitudinal member, in particular if it is made in one piece with it.

Furthermore, in another embodiment of the bogie frame, the lower web of the connection element forms a closure in one plane with a lower web of the longitudinal member, in particular is made in one piece with it, which also leads to an increase in the rigidity.

In another embodiment of the bogie frame, the at least one region with a reduced thickness of the upper web of the connection element only extends over a region to the side, looking orthogonally onto the upper web, of the longitudinal axis of the at least one transverse member. This particular geometry is simple to realize and effectively reduces the stresses in the welded seams which lie nearest to the region with a reduced thickness. The region can be located on the side of the axis facing the other transverse member, or on the other side. It is also possible that the region with a reduced thickness extends across a large part of the width of the transverse member, in particular symmetrically about the longitudinal axis of the transverse member.

In another embodiment of the bogie frame, the length of the region with a reduced thickness on the inner side of the inner ridge and/or of the outer ridge on the longitudinal member corresponds to 0.5 to 2.5 times the diameter of the transverse member. The length of the region with a reduced thickness can however in both cases lie outside the range 0.5 to 2.5 times the diameter of the transverse member.

In a further embodiment of the bogie frame, at least one connection plate is arranged between the transverse member and the connection element and joining the two, which at least partially closes off the connection element and which has an aperture between the connection element and the transverse member in the direction of the joint. Here, the rigidity is increased by this connecting plate, while on the other hand it is possible by changing the stiffness of the plate, for example, by varying the size and shape of the aperture or by milling out areas, to control the stresses in the welded joints, in particular to reduce them.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For the purpose of explaining further the invention, in the following part of the description reference is made to the figures, from which further advantageous embodiments, details and developments of the invention are to be taken in which.

DETAILED DESCRIPTION OF THE EXEMPLARY EMBODIMENTS

Figure 1:
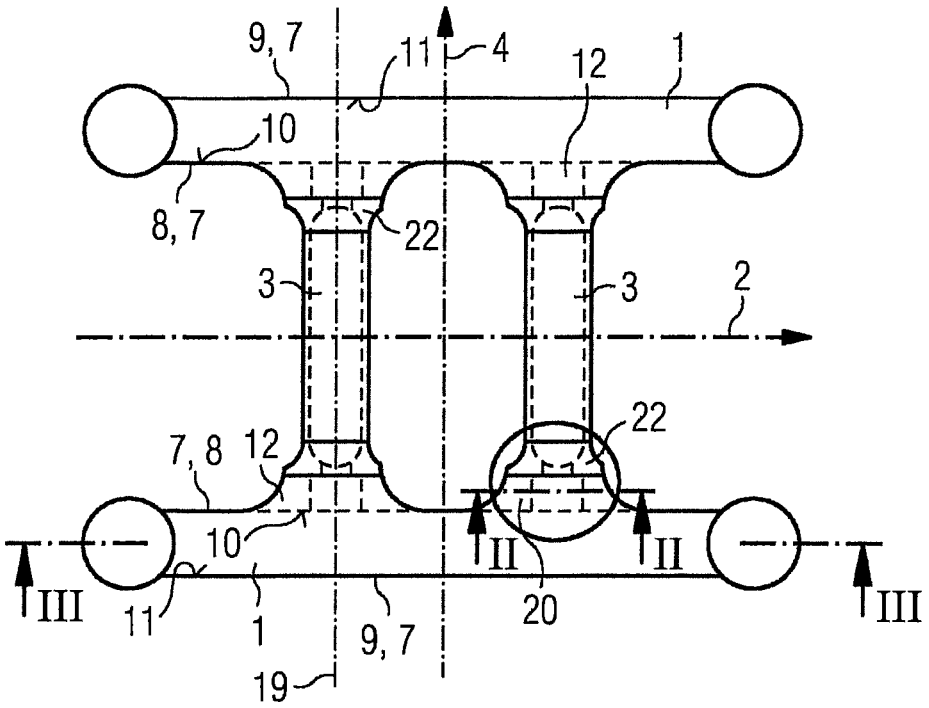
FIG. 1 is a plan view of a bogie frame in accordance with the invention.

FIG. 1 shows a bogie frame that incorporates two longitudinal members 1 and two transverse members 3. Here, the transverse members 3 represent a joining of the two longitudinal members 1. The transverse member 3 are parallel to the transverse direction 4. In FIG. 1, the longitudinal members 1 are aligned parallel to a direction of travel 2. In the central region, they are curved downwards (see FIG. 3).

Between each longitudinal member 1 and each transverse member 3 there is a connection element 12, which joins the remaining part of the longitudinal member with the relevant transverse member 3. In this embodiment (shown in FIG. 2), the connection element 12 incorporates four planar wall elements 7, which are aligned orthogonally to each other, which form an enclosed frame. They are welded to each other and on the outside each has a welded seam between two wall elements 7. However, the connection element 12 can be made up of more or fewer wall elements.

Figure 2:
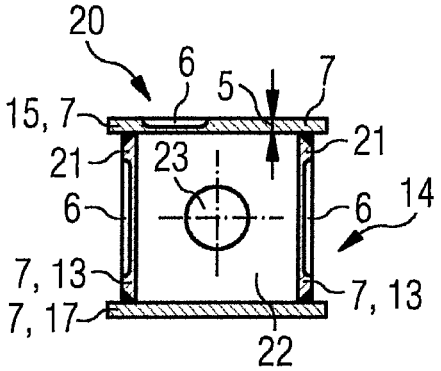
FIG. 2 is a sectional view through a connection element at the line of section A-A in FIG. 1.

FIG. 2 shows a sectional view across the line of intersection A-A in FIG. 1, which extends through the connection element 12. The connection element 12 has two wall elements 7, which are each constructed as connection ridges 13, together with a wall element 7 that is constructed as an upper web 15 of the connection element 12 and as a lower web 17 of the connection element 12. Here, each of the two connection ridges 13 and also the upper web 15 have a region 6 with a reduced thickness. The region 6 with the reduced thickness on the connection ridge 13 extends over the entire outer side 14 of the connection ridge 13 except for a border 21.

The transition zone from the border 21, i.e., from the thickness 5 outside a region 6, to the thickness within the region 6, has the shape of a quadrant arc, and is milled here using a spherical cutter, such as with a radius of 10 mm. The length and width of the region 6 with a reduced thickness depends on the given installation space. As a rule, it is advantageous if, as applicable, the border of each welded seam, or the borders of the wall elements 7, on which the stresses are to be reduced, is/are as narrow as possible. This applies to all the regions 6 shown in the figures.

The remaining thickness of the wall element 7 in FIG. 2 or of the connection ridges 13, as applicable, and of the upper web 15 in the region 6 with a reduced thickness, is approximately 6 mm, the reduction in the thickness of the original thickness 5 of the wall element 7 or of the connection ridges 13, as applicable, and of the upper web 15 amounts to some 10 mm, Hence the original thickness 5 of the wall element is about 16 mm. The thickness of the wall element 7 in the region 6 with a reduced thickness thus corresponds to about 38% of the original thickness 5 of the wall element 7 or of the thickness outside the region 6, as applicable.

The region 6 with a reduced thickness on the outer side 20 of the upper web 15 of the connection element has only one region on its side, looking orthogonally onto the upper web 15, on the longitudinal axis of the at least one transverse member 3, and that is on the side that faces towards the other transverse member 3. Here, the area of the region 6 corresponds to about 20% of the outer surface of the upper web 15. In this region, the welded seam between the upper web 15 and the connection plate 22 is highly stressed. With the reduction in the thickness of the upper web 15, this region is more pliable. The bending in the root of the welded seam is thereby reduced and the stress on the welded seam drops.

Around the region 6 of each connection ridge 13, there is a border 21 with a uniform width, so that the region 6 with a reduced thickness corresponds to about 80% of the surface of the outer side 14. Thus there is a border 21 on the upper side of the connection ridge 13, towards the upper web 15, so that the stress on the welded seam between the connection ridge 13 and the upper web 15 is reduced. There is also a border 21 on the lower side of the connection ridge 13, towards the lower web 17, so that the stress on the welded seam between the connection ridge 13 and the lower web 17 is reduced. Because of the border 21 between the connection ridge 13 and the inner ridge 8 on the longitudinal member 1, the region 6 also extends almost as far the ridge 8, so that stress on the welded seam between the connection ridge 13 and the ridge 8 is reduced. Because of the border 21 between the connection ridge 13 and the connection plate 22, the region 6 also extends almost as far as the connection plate 22, so that the stress on the welded seam between the connection ridge 13 and the connection plate 228 is also reduced.

The connection plate 22 (see FIG. 1) that is arranged adjacent to the connection element 12 has an aperture 23 (see FIG. 2). In the embodiment shown in FIG. 2, this aperture is round in shape, because the transverse member 3 has a round cross-section (circular shaped hollow profile, see the dashed representation in FIG. 1). However, it is also conceivable that the aperture takes any other shape, also conceivable are shapes which on the longitudinal member's 1 side have a shape or size other than on the transverse member's 3 side, in order to ensure an optimal transition from the longitudinal member 1 to the transverse member 3.

Together with the upper web 15 and the lower web 17, the connection ridges 13 form a box profile. In this example, this is formed in that the two connection ridges 13 together with the upper web 15 and the lower web 17 are arranged parallel to each other, where in the operating position the connection elements 13 are arranged vertically, and the upper web 15 and the lower web 17 are arranged horizontally. Each connection ridge 13 is orthogonal to both the upper web 15 and also to the lower web 17. However, the box profile can also be formed from wall elements that are not positioned parallel to each other.

Figure 5:
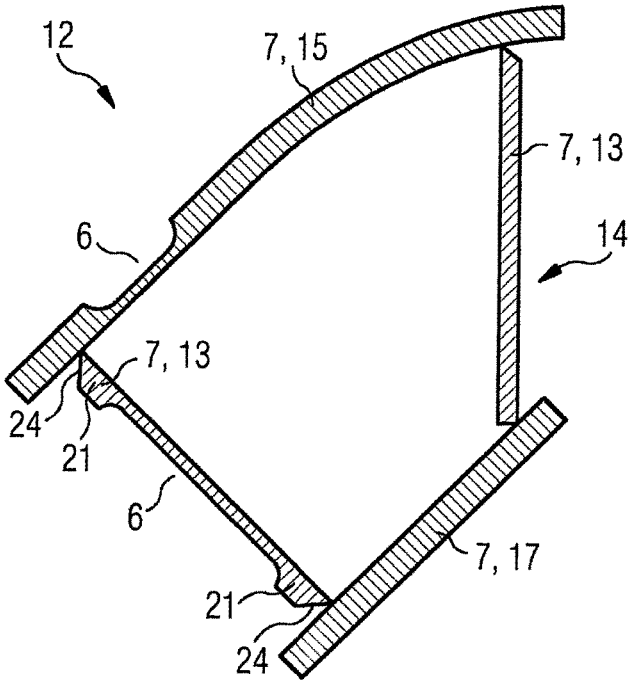
FIG. 5 is a sectional view through a connection element at the line of section A-A in FIG. 1 in accordance with an alternative embodiment.

FIG. 5 shows a section through an alternative embodiment of the connection element 12 along the section line A-A in FIG. 1. Here, unlike the embodiment shown in FIG. 2, the two planar connection ridges 13 are not parallel to each other, one connection ridge stands perpendicularly to both the upper web 15 and also to the lower web 17, the other connection ridge 13 does not stand on either of the two normals. The lower web 17 (here planar) can be arranged horizontally in the plane of the bogie frame (see FIG. 2) or at an inclination that corresponds to the line of the curvature in the longitudinal member 1 at the site of the connection element 12 (see FIG. 5), and the upper web 15 in FIG. 5 follows the line of the curvature in the longitudinal member 1 or the line of the upper web 16 of the longitudinal member 1, as applicable. The upper web 15, which is curved, is arranged with sections of it parallel to the lower web 17.

Only the left-hand connection ridge 13 and the upper web 15 in FIG. 5 each has a region 6 with a reduced wall thickness. In the region 6 on the left-hand connection ridge 13 there remains about 40% of the original wall thickness of the connection ridge 13, where the region 6 extends over a large part of the height of the connection ridge 13. The border 21 around the region 6 is then only about as high as the welded seam chamfer 24. The region 6 on the upper web 15 is provided on the outer side, close to the left-hand connection ridge 13, and also has about 40% of the wall thickness of the remainder of the upper web 15. However, the region 6 on the upper web 15 only extends over around one sixth of the width (measured from the bottom left to the top right) of the upper web 15. The depth of the region 6 (measured perpendicularly to the plane of the drawing) could be equal to the width, producing an essentially square shape of the region 6 on the upper web 15, and leaving a border 21 (with a similar width as for the connection ridge 13) also on the inner ridge 8 on the longitudinal member 1.

Because the region 6 on the left-hand connection element 13 extends close to the upper side of the connection element 13, this reduces the stress on the welded seam between the connection element 13 and the upper web 15, which is defined by the welded seam chamfer 24. In the same way, the extension of the region 6 of the upper web 15 close to the upper side of the connection element 13 achieves a stress reduction for this welded seam.

However, in FIG. 5 the two connection ridges 13 and/or the lower web 17 could also have one or more regions 6 with a reduced wall thickness.

Figure 3:
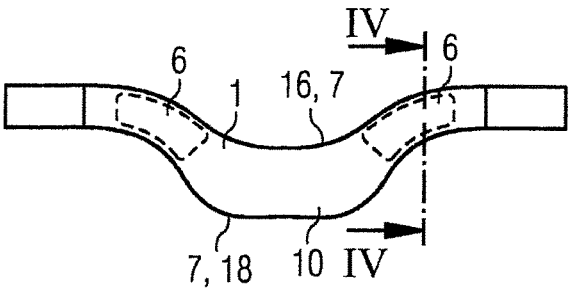
FIG. 3 is a sectional view at the line of section C-C in FIG. 1.
Figure 4:
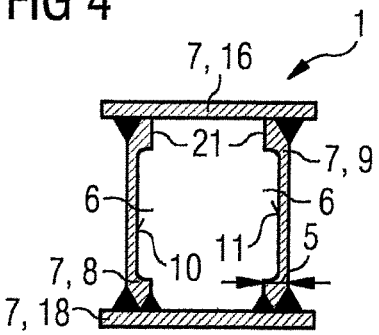
FIG. 4 is a sectional view at the line of section B-B in FIG. 3.

The longitudinal members 1 are in the form of open or closed hollow profiles, and are constructed from wall elements 7 (see FIGS. 1,3,4). Here, in each case one wall element 7 of each longitudinal member 1 forms an internal ridge 8 and one forms an external ridge 9. The internal ridge 8 has an inner side 10, and the external ridge 9 an inner side 11. Both the inner side 10 and also the inner side 11 have a region 6 with a reduced thickness (see FIGS. 3,4).

The region 6 with a reduced thickness on both the inner side 10 of the internal ridge 8 and also on the inner side 11 of the external ridge 9 is lengthwise in form, and thus extends in the longitudinal direction of the longitudinal member 1. It follows the line of the curvature. It is at the same distance from both the upper web 16 and also from the lower web 18. In the longitudinal direction, the boundary of the region 6 thus extends parallel to the upper web 16 and to the lower web 18, and in the transverse direction perpendicularly to the upper web 16 and the lower web 18. However, in the transverse direction, the line of the region 6 need not be perpendicular to the upper or lower web 16, 18.

The regions 6 with a reduced thickness of the inner side 10 of the internal ridge 8 and the inner side 11 of the external ridge 9 are made to cover congruent areas. The lengths of the regions 6 (measured along the longitudinal member 1) generally amount to between 0.5 and 2.5 times the diameter of the transverse member 3. In this example, the region 6 is about 290 mm long, the diameter of the tube of the transverse member 3 is about 190 mm. Hence, in this example, the length of the region 6 amounts to some 1.5 times the diameter of the transverse member 3. However, the ratio of the length of the region 6 to the transverse member 3 can also be larger or smaller than 0.5 to 2.5.

Depicted in FIG. 4 on the longitudinal member 1 are six welded seams, with the help of which both the upper web 16 and also the lower web 18 are affixed on the internal ridge 8 and on the external ridge 9. Here, the upper web 16 is in each case attached by an external welded seam to the internal ridge 8 and the external ridge 9, and the lower web 18 is in each case affixed by both an internal and also an external welded seam to the internal ridge 8 and to the external ridge 9.

Around the region 6 where thickness of the ridges 8, 9 is reduced, the latter have a border 21 which covers 10 to 30%, here around 20% of the height (in FIG. 4 running in a vertical direction) of the inner side of the ridges 8, 9. There is a border 21 between the region 6 and the upper side of the ridge 8, 9, as far as the upper web 16 of the longitudinal member 1, and there is a border 21 on the lower side of the ridge 8, 9, as far as the lower web 16 of the longitudinal member 1. There thus remains around 60% of the height of the ridge 8, 9 for the region 6 with a reduced thickness. Because in each case the welded seams between the upper side of the ridge 8, 9 and the upper web 16 and between the lower side of the ridge 8, 9 and the lower web 18 lie in the immediate neighborhood of the region 6, the stresses in them are reduced by the region 6.

In this example, the ridges 8, 9 have a thickness 5 of 14 mm, in the regions 6 with a reduced thickness this thickness is reduced to 7 mm, so that the thickness of the ridges 8, 9 in the region 6 with a reduced thickness amounts to 50% of the thickness of the ridges 8, 9 outside the region 6 with a reduced thickness. It should be understood, the thickness ratio for the ridges 8, 9 on longitudinal members 1 can, for other exemplary embodiments, deviate from 50%, for example, can lie in the range of 30-70%.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those element steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A bogie frame for a rail vehicle, comprising:

a plurality of longitudinal members constructed as open or closed hollow profiles; and at least one transverse member;

wherein each hollow profile of the longitudinal member is formed by wall elements having a particular thickness;

wherein, in a region at which the at least one transverse member is affixed, each of the plurality of longitudinal members includes a wall element having at least one region with a reduced thickness;

wherein each of the plurality of longitudinal members incorporates at least one connection element which serves as a connection for the at least one transverse member and which includes at least one wall element with a region having the reduced thickness;

wherein the connection element is constructed as a box profile having two wall elements comprising connection ridges together with a wall element comprising an upper web which joins two connection ridges and a wall element as a lower web, which also joins the two connection ridges;

wherein the two connection ridges together with the upper web and the lower web stand orthogonally on a side of the longitudinal member facing the at least one transverse member; and wherein, in an operating position, the upper web is arranged at the top and the lower web at the bottom.

2. The bogie frame as claimed in claim 1, wherein, in the at least one region with the reduced thickness, the thickness of the wall element amounts at most to 90% of the thickness of the wall element outside the region with a reduced thickness.

3. The bogie frame as claimed in claim 2, wherein each of the plurality of longitudinal members includes, on a side which faces the at least one transverse member, a wall element comprising an internal ridge with an inner side having a reduced thickness.

4. The bogie frame as claimed in claim 2, wherein the thickness of the wall element lies in the range from 10-90%.

5. The bogie frame as claimed in claim 4, wherein the thickness of the wall element lies in the range from 30-70%.

6. The bogie frame as claimed in claim 1, wherein each of the plurality of longitudinal members includes, on a side which faces the at least one transverse member, a wall element comprising an internal ridge with an inner side having a reduced thickness.

7. The bogie frame as claimed in claim 6, wherein, around the at least one region having the reduced thickness, there remains at least in parts a border which extends over 10-30% of a height of the internal and external ridges.

8. The bogie frame as claimed in claim 6, wherein a length of the region with a reduced thickness on the inner side corresponds to between 0.5 and 2.5 times a diameter of the at least one transverse member.

9. The bogie frame as claimed in claim 1, wherein each of the plurality of longitudinal members includes a wall element comprising an external ridge having an inner side which lies opposite an internal ridge which faces the at least one transverse member and at least one region having a reduced thickness arranged on the inner side.

10. The bogie frame as claimed in claim 9, wherein, around the at least one region having the reduced thickness, there remains at least in parts a border which extends over 10-30% of a height of the internal and external ridges.

11. The bogie frame as claimed in claim 9, wherein a length of the region with a reduced thickness on the inner side corresponds to between 0.5 and 2.5 times a diameter of the at least one transverse member.

12. The bogie frame as claimed in claim 1, wherein the connection ridge includes at least one region having the reduced thickness.

13. The bogie frame as claimed in claim 12, wherein the connection ridge includes a border having a uniform width arranged around the at least one region having the reduced thickness.

14. The bogie frame as claimed in claim 12, wherein the at least one region having the reduced thickness is provided on an outer side of the connection ridge.

15. The bogie frame as claimed in claim 12, wherein the at least one region having the reduced thickness corresponds to 20-90% of a surface of the outer side.

16. The bogie frame as claimed in claim 15, wherein the region with the reduced thickness corresponds to 40-80% of a surface of the outer side.

17. The bogie frame as claimed in claim 1, wherein the upper web includes at least one region with a reduced thickness.

18. The bogie frame as claimed in claim 17, wherein the at least one region with a reduced thickness is provided on an outer side of the upper web of the connection element.

19. The bogie frame as claimed in claim 17, wherein the at least one region having the reduced thickness of the upper web of the connection element incorporates only a region to the side, when looking orthogonally down onto the upper web, of the longitudinal axis of the at least one transverse member.

20. The bogie frame as claimed in claim 1, wherein the upper web of the connection element terminates planar with an upper web of the longitudinal member and is constructed with it as a single part.

21. The bogie frame as claimed in claim 20, wherein the upper web of the connection element is constructed as a single part with the upper web of the longitudinal member.

22. The bogie frame as claimed in claim 1, wherein the lower web of the connection element terminates planar with a lower web of the longitudinal member.

23. The bogie frame as claimed in claim 22, wherein the lower web of the connection element is constructed as a single part with the lower web of the longitudinal member.

24. The bogie frame as claimed in claim 1, further comprising:

at least one connection plate at least partially closing off the connection element and arranged between the transverse member and the connection element, said at least one connection plate having an aperture in a direction of the joint between the connection element and the transverse member, and said at least one connection plate joining the transverse member and the connection element.

* * * * *